US008547235B2

(12) United States Patent
Tomoda

(10) Patent No.: US 8,547,235 B2
(45) Date of Patent: Oct. 1, 2013

(54) SECURITY DEVICE AND SECURITY SYSTEM DETERMINING IF THE USER CAN HEAR AN AUDIBLE ALARM

(75) Inventor: Takahito Tomoda, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 470 days.

(21) Appl. No.: 12/898,224

(22) Filed: Oct. 5, 2010

(65) Prior Publication Data

US 2011/0080292 A1 Apr. 7, 2011

(30) Foreign Application Priority Data

Oct. 6, 2009 (JP) ..... 2009-232061

(51) Int. Cl.
*G08B 21/00* (2006.01)

(52) U.S. Cl.
USPC ..... 340/573.1; 340/540; 340/691.1

(58) Field of Classification Search
USPC ..... 340/573.1, 539.1, 539.11, 691.1, 340/691.4
See application file for complete search history.

(56) References Cited

U.S. PATENT DOCUMENTS

2010/0277316 A1* 11/2010 Schlangen et al. ..... 340/540
2010/0302033 A1* 12/2010 Devenyi et al. ..... 340/540

FOREIGN PATENT DOCUMENTS

| | | | |
|---|---|---|---|
| JP | 7-50710 | A | 2/1995 |
| JP | 2004-47346 | A | 2/2004 |
| JP | 2005-38401 | A | 2/2005 |
| JP | 2005-301355 | A | 10/2005 |
| JP | 2008-204393 | A | 9/2008 |

* cited by examiner

*Primary Examiner* — Jeffery Hofsass
(74) *Attorney, Agent, or Firm* — Crowell & Moring LLP

(57) ABSTRACT

This security device includes a control portion determining whether or not a user can hear an alarm sound for informing the user of an abnormality when the abnormality occurs and informing the user of the abnormality by generating the alarm sound, or illuminating or blinking a light in a house of the user, depending on determination whether or not the user can hear the alarm sound.

20 Claims, 4 Drawing Sheets

FIG.3

| EXAMPLE OF LIGHT ALARM | | | |
|---|---|---|---|
| DEVICE | FIRE SENSOR | INDOOR SENSOR | OUTDOOR SENSOR |
| ILLUMINATION COLOR | RED | BLUE | GREEN |
| PATTERN | FIRST PATTERN<br>ON<br>OFF<br>T1<br>TIME | SECOND PATTERN<br>ON<br>OFF<br>T3<br>T2<br>TIME | THIRD PATTERN<br>ON<br>OFF<br>T4<br>TIME |

SECURITY DEVICE AND SECURITY SYSTEM DETERMINING IF THE USER CAN HEAR AN AUDIBLE ALARM

BACKGROUND OF THE INVENTION

1. Field of the Invention

The present invention relates to a security device and a security system, and more particularly, it relates to a security device and a security system informing a user of an abnormality.

2. Description of the Background Art

A security device and a security system informing a user of an abnormality is known in general, as disclosed in each of Japanese Patent Laying-Open Nos. 2004-47346, 2005-301355 and 2008-204393, for example.

The aforementioned Japanese Patent Laying-Open No. 2004-47346 discloses a lighting control system (security system) comprising a master controller (control portion) illuminating or blinking a light fixture at the same time of generating a buzzer sound when intrusion of a human (an abnormality) is detected.

The aforementioned Japanese Patent Laying-Open No. 2005-301355 discloses a security device (security system) comprising a sound output portion capable of generating an alarm sound and a control portion blinking a light source portion (light) at the same time of generating the alarm sound when a sensor (abnormality detection portion) detects a human. The control portion of the security device according to the aforementioned Japanese Patent Laying-Open No. 2005-301355 turns down the volume of the alarm sound generated from the sound output portion and changes the frequency of the alarm sound in order for the alarm sound not to become noise for the neighbors when the surrounding environment is quiet, such as at night. The control portion of the security device turns up the volume of the alarm sound generated from the sound output portion and changes the frequency of the alarm sound in order for the alarm sound not to be buried by noise of the surrounding environment when the surrounding environment is noisier than that at night, such as in the daytime.

The aforementioned Japanese Patent Laying-Open No. 2008-204393 discloses a lighting system (security system) controlling illumination of a light fixture (light) when a microphone acquires an alarm sound informed by a fire alarm.

In each of the lighting control system (security system) and the like according to the aforementioned Japanese Patent Laying-Open Nos. 2004-47346, 2005-301355 and 2008-204393, however, the light is always illuminated or blinked together with an alarm sound. Consequently, power consumption of the security system (security device) is disadvantageously increased by illuminating or blinking the light and emitting the alarm sound each time the security system (security device) informs an abnormality.

SUMMARY OF THE INVENTION

The present invention has been proposed in order to solve the aforementioned problems, and an object of the present invention is to provide a security device and a security system capable of suppressing increase in power consumption.

A security device according to a first aspect of the present invention comprises a security device body placed in a house of a user and a control portion provided inside the security device body, determining whether or not the user can hear an alarm sound for informing the user of an abnormality when the abnormality occurs and informing the user of the abnormality by generating the alarm sound, or illuminating or blinking a light in the house of the user, depending on determination whether or not the user can hear the alarm sound.

As hereinabove described, the security device according to the first aspect determines whether or not the user can hear the alarm sound for informing the user of the abnormality when the abnormality occurs and informs the user of the abnormality by generating the alarm sound, or illuminating or blinking the light in the house of the user, depending on the determination whether or not the user can hear the alarm sound, thereby being capable of informing the user of the abnormality by selecting either the alarm sound or the illumination or blinking of the light on the basis of the determination whether the user can hear or cannot hear the alarm sound. Thus, the user can be informed of the abnormality without both generating the alarm sound and illuminating or blinking the light, and hence increase in power consumption of the security device at the time of informing the user of the abnormality can be suppressed as compared with a case where the user is always informed of the abnormality by both the alarm sound and the illumination or blinking of the light.

In the aforementioned security device according to the first aspect, the control portion is preferably formed to inform the user of the abnormality by illuminating or blinking the light in the house of the user without generating the alarm sound when determining that the user cannot hear the alarm sound and inform the user of the abnormality by generating the alarm sound without illuminating or blinking the light in the house of the user when determining that the user can hear the alarm sound. According to this structure, the user can be informed of the abnormality by illuminating or blinking the light in the house of the user without generating the alarm sound under an environment where the user cannot hear the alarm sound and be informed of the abnormality by generating the alarm sound without illuminating or blinking the light in the house of the user under an environment where the user can hear the alarm sound. Thus, the user can be informed of the abnormality by employing only either a sound or a light, and hence increase in power consumption of the security device at the time of informing the user of the abnormality can be further suppressed.

In the aforementioned security device according to the first aspect, the control portion is preferably formed to determine whether or not the user can hear the alarm sound on the basis of the magnitude of sound around the user at the time of informing the user of the abnormality and the magnitude of the alarm sound. According to this structure, the security device can easily determine whether or not the user can hear the alarm sound by comparing the magnitude of the sound around the user at the time of informing the user of the abnormality with the magnitude of the alarm sound.

In the aforementioned security device according to the first aspect, the control portion is preferably formed to vary at least either an illumination color or an emission pattern depending on the type of the abnormality and illuminate or blink the light in the house of the user when the abnormality occurs. According to this structure, the user can easily recognize the type of the abnormality on the basis of the color or the pattern corresponding to the type of the abnormality when being informed of the abnormality by the light.

The aforementioned security device according to the first aspect preferably further comprises a communication portion provided in the security device body, wherein the control portion is formed to inform the user of the abnormality by the alarm sound or the light and inform a previously registered portable terminal of information about the abnormality through the communication portion when the abnormality occurs. According to this structure, a third party going out etc. other than the user in the house can be informed of the abnormality if the third party other than the user in the house has the previously registered portable terminal, and hence it can be more reliably informed of the abnormality.

In this case, the control portion is preferably formed to inform the previously registered portable terminal that it is a case where the user cannot hear the alarm sound in addition to the information about the abnormality when informing the previously registered portable terminal of the information about the abnormality in a case of determining that the user cannot hear the alarm sound. According to this structure, the user going out etc. of the previously registered portable terminal informed of the abnormality can be informed of the more accurate information about the abnormality.

In the aforementioned security device informing the previously registered portable terminal of the information about the abnormality through the communication portion, the control portion is preferably formed to inform the previously registered portable terminal of the information about the abnormality through the communication portion by employing an E-mail when the abnormality occurs. According to this structure, the user going out etc. of the previously registered portable terminal informed of the abnormality can be easily informed of the more accurate information about the abnormality by employing an E-mail.

The aforementioned security device according to the first aspect preferably further comprises a communication portion provided in the security device body, wherein the control portion is formed to turn down the volume of a sound emitted from a device making a sound, capable of communicating with the communication portion, being in an ON-state when determining that the device is in the ON-state in a case of determining that the user can hear the alarm sound. According to this structure, the alarm sound can be more easily received by the user by turning down the volume of the sound emitted from the device making a sound when the user is informed of the abnormality by the alarm sound.

In this case, the device making a sound preferably includes a headphone capable of communication through radio communication, the communication portion is preferably formed to communicate with the headphone through radio communication, and the control portion is preferably formed to turn down the volume of a sound emitted from the headphone being in an ON-state through the communication portion communicating with the headphone through radio communication when determining that the headphone is in the ON-state. According to this structure, the alarm sound can be more easily received by the user effectively by communicating with the headphone by radio for turning down the volume of the sound emitted from the device making a sound also when the headphone has a volume control.

The aforementioned security device according to the first aspect preferably further comprises an informing portion capable of generating an alarm sound, wherein the control portion is formed to allow the informing portion to emit the alarm sound when determining that the user can hear the alarm sound. According to this structure, an alarm sound can be generated by the informing portion of the security device also when there is no device generating an alarm sound except the security device.

The aforementioned security device according to the first aspect preferably further comprises a sound detection portion detecting sound around the user, wherein the control portion is formed to determine whether or not the user can hear the alarm sound on the basis of the magnitude of sound around the user at the time when the abnormality occurs, detected by the sound detection portion and the magnitude of the alarm sound. According to this structure, the magnitude of sound around the user being probably near the security device can be easily detected by the sound detection portion, and hence the security device can easily determine whether or not the user can hear the alarm sound.

The aforementioned security device according to the first aspect preferably further comprises a display portion serving as an electronic photo frame, capable of displaying a photo image. According to this structure, a security terminal can be also employed as an electronic photo frame.

The aforementioned security device according to the first aspect preferably further comprises a communication portion provided in the security device body, wherein the abnormality is detected by a motion sensor detecting an intruder, and the control portion is formed to determine that the abnormality is occurring when being informed of information about the abnormality detected by the motion sensor through the communication portion. According to this structure, the security device is informed of the abnormality by the motion sensor when an intruder intrudes, and hence the user can be informed of the abnormality in which the intruder intrudes.

In this case, the communication portion preferably includes a specified low power radio module capable of communicating with the motion sensor by a radio communication module having a maximum electric power strength of not more than a prescribed magnitude, and the control portion is preferably formed to determine that the abnormality is occurring when being informed of the information about the abnormality detected by the motion sensor through the specified low power radio module. According to this structure, increase in power consumption of the security device can be further suppressed by communicating with the motion sensor through the specified low power radio module, as compared with a case of communicating with the motion sensor by employing a radio communication module having a maximum electric power strength of more than the prescribed magnitude.

The aforementioned security device according to the first aspect preferably further comprises a communication portion provided in the security device body, wherein the abnormality is detected by a fire sensor detecting whether or not a fire is breaking out, and the control portion is formed to determine that the abnormality is occurring when being informed of information about the abnormality detected by the fire sensor through the communication portion. According to this structure, the security device is informed of the abnormality by the fire sensor when a fire breaks out, and hence the user can be informed of the abnormality in which a fire breaks out.

A security system according to a second aspect of the present invention comprises a light placed in a house of a user and a security device including a security device body placed in the house of the user and a control portion provided inside the security device body, determining whether or not the user can hear an alarm sound for informing the user of an abnormality when the abnormality occurs and informing the user of the abnormality by generating the alarm sound, or illuminating or blinking the light in the house of the user, depending on determination whether or not the user can hear the alarm sound.

As hereinabove described, the security system according to the second aspect determines whether or not the user can hear the alarm sound for informing the user of the abnormality when the abnormality occurs and informs the user of the abnormality by generating the alarm sound, or illuminating or blinking the light in the house of the user, depending on the determination whether or not the user can hear the alarm sound, thereby being capable of informing the user of the abnormality by selecting either the alarm sound or the illumination or blinking of the light on the basis of the determination whether the user can hear or cannot hear the alarm sound. Thus, the user can be informed of the abnormality without both generating the alarm sound and illuminating or blinking the light, and hence increase in power consumption of the security device at the time of informing the user of the abnormality can be suppressed as compared with a case where the user is always informed of the abnormality by both the alarm sound and the illumination or blinking of the light.

In the aforementioned security system according to the second aspect, the control portion of the security device is preferably formed to inform the user of the abnormality by illuminating or blinking the light in the house of the user without generating the alarm sound when determining that the user cannot hear the alarm sound and inform the user of the abnormality by generating the alarm sound without illuminating or blinking the light in the house of the user when determining that the user can hear the alarm sound. According to this structure, the user can be informed of the abnormality by illuminating or blinking the light in the house of the user without generating the alarm sound under an environment where the user cannot hear the alarm sound and be informed of the abnormality by generating the alarm sound without illuminating or blinking the light in the house of the user under an environment where the user can hear the alarm sound. Thus, the user can be informed of the abnormality by employing only either a sound or a light, and hence increase in power consumption of the security device at the time of informing the user of the abnormality can be further suppressed.

In the aforementioned security system according to the second aspect, the control portion of the security device is preferably formed to determine whether or not the user can hear the alarm sound on the basis of the magnitude of sound around the user at the time of informing the user of the abnormality and the magnitude of the alarm sound. According to this structure, the security system can easily determine whether or not the user can hear the alarm sound by comparing the magnitude of the sound around the user at the time of informing the user of the abnormality with the magnitude of the alarm sound.

In the aforementioned security system according to the second aspect, the control portion of the security device is preferably formed to vary at least either an illumination color or an emission pattern depending on the type of the abnormality and illuminate or blink the light in the house of the user when the abnormality occurs. According to this structure, the user can easily recognize the type of the abnormality on the basis of the color or the pattern corresponding to the type of the abnormality when being informed of the abnormality by the light.

In the aforementioned security system according to the second aspect, the security device preferably further includes a communication portion provided in the security device body, and the control portion of the security device is preferably formed to inform the user of the abnormality by the alarm sound or the light and inform a previously registered portable terminal of information about the abnormality through the communication portion when the abnormality occurs. According to this structure, a third party going out etc. other than the user in the house can be informed of the abnormality if the third party other than the user in the house has the previously registered portable terminal, and hence it can be more reliably informed of the abnormality.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 3 illustrates an illumination color and an emission pattern when a security device in the security system according to the embodiment of the present invention gives an alarm.

DESCRIPTION OF THE PREFERRED EMBODIMENTS

An embodiment of the present invention is now described with reference to the drawings.

First, the structure of a security system 1 according to an embodiment of the present invention is described with reference to FIGS. 1 and 2.

Figure 1:
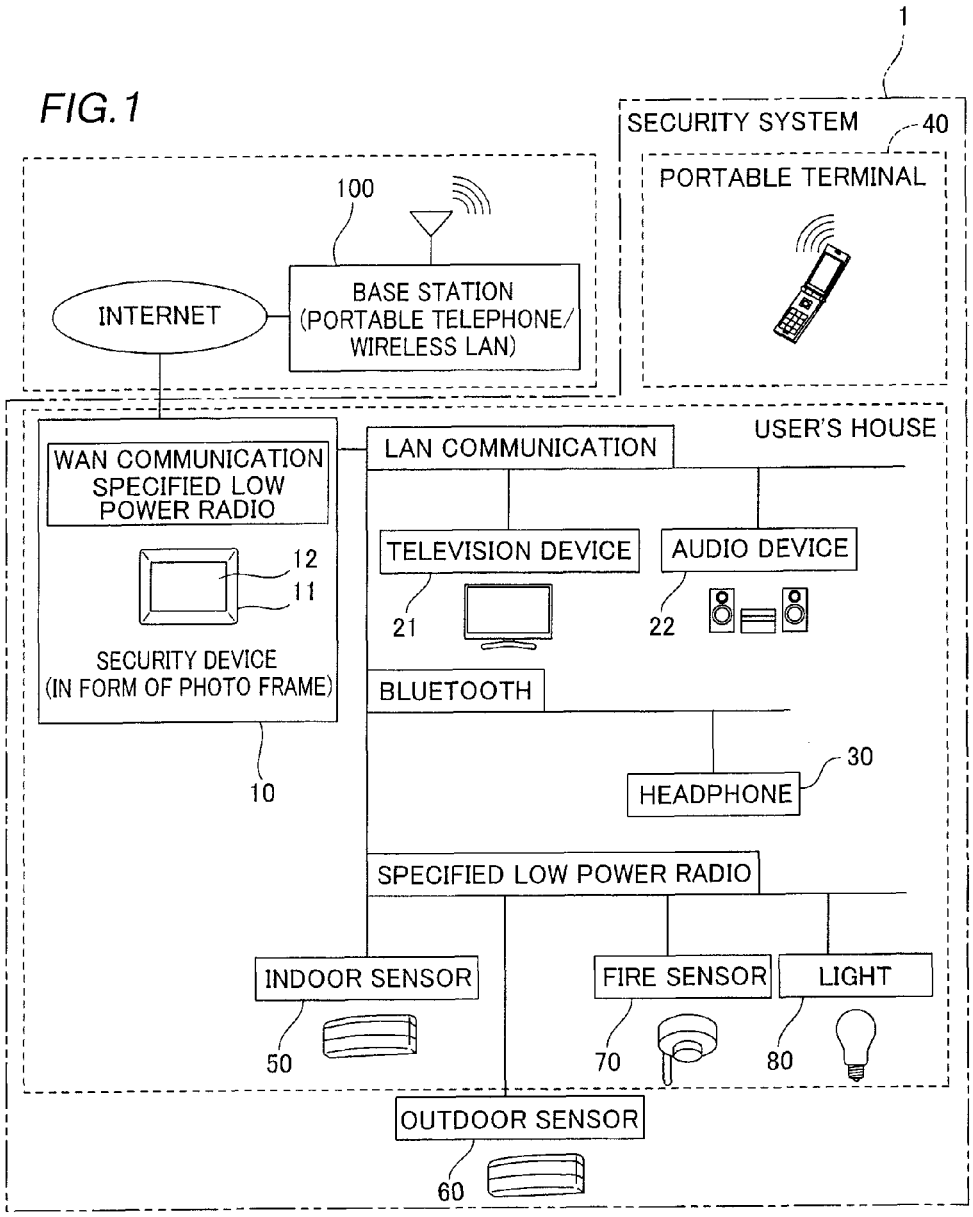
FIG. 1 is a system chart for illustrating the structure of a security system according to an embodiment of the present invention.
Figure 2:
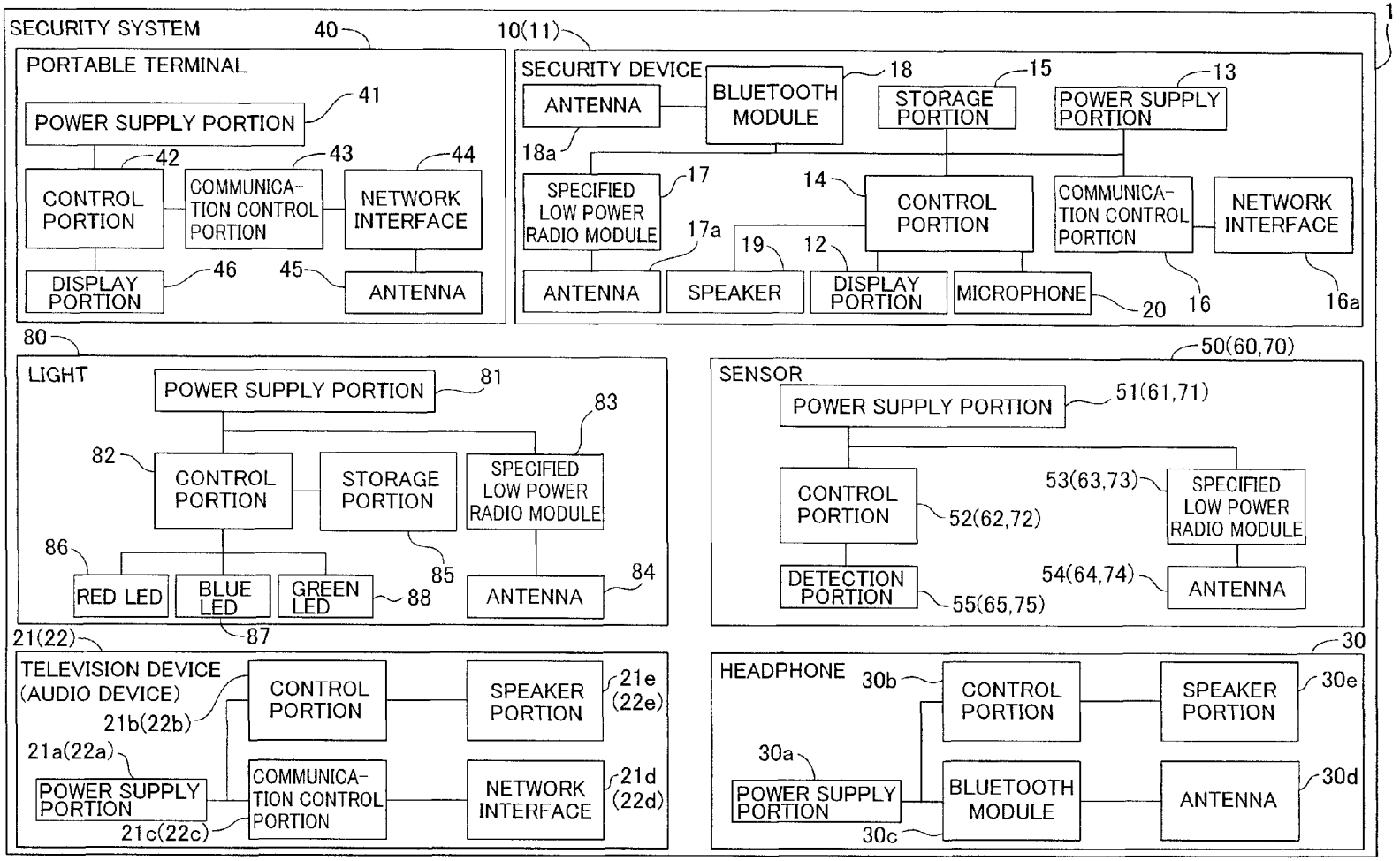
FIG. 2 is a block diagram for illustrating the structure of the security system according to the embodiment of the present invention.

As shown in FIG. 1, the security system 1 is constituted by a security device 10 for informing a user of an abnormality when the abnormality occurs, a television device 21 and an audio device 22 capable of communicating with the security device 10 through in-home communication, a headphone 30 capable of communicating with the security device 10 by Bluetooth (registered trademark), a portable terminal 40 capable of communicating with the security device 10 by employing an external communication base station 100, and an indoor sensor 50, an outdoor sensor 60, a fire sensor 70 and a light 80 capable of communicating with the security device 10 through weak radio waves. Each of the television device 21, the audio device 22 and the headphone 30 is an example of "device making a sound" in the present invention. Each of the indoor sensor 50 and the outdoor sensor 60 is an example of the "motion sensor" in the present invention.

The security device 10 is placed in a house of a user and has a body 11 in the form of an electronic photo frame. The body 11 is an example of the "security device body" in the present invention. This security device 10 is constituted by a display portion 12 capable of electronically displaying a photo image, a power supply portion 13, a control portion 14 controlling the security device 10, a storage portion 15 storing an E-mail address or the like, a communication control portion 16 and a network interface 16*a* corresponding to WAN (Wide Area Network) and LAN (Local Area Network), as shown in FIG. 2. The security device 10 is further constituted by a specified low power radio module 17, an antenna 17*a*, a Bluetooth module 18, an antenna 18*a*, a speaker 19 and a microphone 20. Each of the communication control portion 16, the specified low power radio module 17 and the Bluetooth module 18 is an example of the "communication portion" in the present invention. The speaker 19 is an example of the "informing portion" in the present invention, and the microphone 20 is an example of the "sound detection portion" in the present invention.

The power supply portion 13 has a function of supplying power to each part of the security device 10. The communication control portion 16 has a function of performing data information processing when performing data communication with the television device 21, the audio device 22 and the portable terminal 40. The network interface 16*a* has a function of communicating with the television device 21, the audio device 22 and the portable terminal 40 by employing WAN or LAN. The specified low power radio module 17 is a radio communication module transmitting radio waves having a maximum electric power strength of not more than a prescribed magnitude (0.01 W) and is employed in communicating with a device close thereto. In this case, the security device 10 is formed to be capable of communicating with the indoor sensor 50, the outdoor sensor 60, the fire sensor 70 and the light 80 by transmitting weak radio waves through the antenna 17*a* by the specified low power radio module 17. The Bluetooth module 18 is formed to be capable of reciprocally performing data communication with the headphone 30 through the antenna 18*a*. In the Bluetooth module 18, a pairing passkey is so previously set as to be capable of communicating with the headphone 30. The pairing passkey is a communication cipher capable of being set in each Bluetooth module to perform Bluetooth communication between devices having Bluetooth modules. The speaker 19 is formed to be capable of generating an alarm sound when an abnormality occurs. The microphone 20 is provided for detecting sound around the security device 10. Sound around the user can be detected by this microphone 20.

According to the embodiment, the control portion 14 of the security device 10 is provided in the body 11. This control portion 14 has a function of determining whether or not the user can hear an alarm sound for informing the user of an abnormality when being notified of a signal indicating the abnormality by the indoor sensor 50, the outdoor sensor 60 and the fire sensor 70. Further, the control portion 14 has a function of informing the user of the abnormality by generating an alarm sound or blinking the light 80 in the user's house in response to the determination of whether or not the user can hear the alarm sound. More specifically, the control portion 14 is so formed that the microphone 20 collects sound around the security device 10. The control portion 14 is so formed to determine whether or not the user can hear the alarm sound by comparing the magnitude of the collected sound with the magnitude of the alarm sound capable of being generated from the speaker 19. The control portion 14 is formed to inform the user of the abnormality by allowing the speaker to generate the alarm sound when determining that the user can hear the alarm sound, and to inform the user of the abnormality by blinking the light 80 in the user's house when determining that the user cannot hear the alarm sound. An E-mail address of the portable terminal 40 or the like is previously registered in the storage portion 15 for informing that there is an abnormality when the abnormality occurs. The control portion 14 is formed to send an E-mail stating that there is an abnormality to the E-mail address or the like of the portable terminal 40 stored in the storage portion 15 when the abnormality occurs.

The television device 21 and the audio device 22 are connected to the security device 10 through a LAN cable (not shown) and are formed to be capable of communicating with the security device 10. More specifically, the television device 21 is mainly constituted by a power supply portion 21*a*, a control portion 21*b* controlling the television device 21, a communication control portion 21*c*, a network interface 21*d* and a speaker portion 21*e*. More specifically, the audio device 22 is mainly constituted by a power supply portion 22*a*, a control portion 22*b* controlling the audio device 22, a communication control portion 22*c*, a network interface 22*d* and a speaker portion 22*e*. The power supply portions 21*a* and 22*a* have functions of supplying power to each part of the television device 21 and the audio device 22, respectively. The communication control portions 21*c* and 22*c* each have a function of performing data information processing when performing data communication with the security device 10. The network interfaces 21*d* and 22*d* each have a function of performing communication processing with the security device 10 by employing WAN or LAN. The speaker portions 21*e* and 22*e* are formed to make sounds in use of the television device 21 and the audio device 22, respectively. The magnitudes of the sounds emitted from these speaker portions 21*e* and 22*e* can be adjusted by the control portions 21*b* and 22*b*, respectively. The control portions 21*b* and 22*b* are formed to be capable of changing the magnitudes of the sounds emitted from the speaker portions 21*e* and 22*e* on the basis of an operation signal transmitted from the security device 10 through the communication control portions 21*c* and 22*c*, respectively.

The headphone 30 is connected to the security device 10 through Bluetooth communication by setting the pairing passkey as hereinabove described. More specifically, the headphone 30 is mainly constituted by a power supply portion 30*a*, a control portion 30*b* controlling the headphone 30, a Bluetooth module 30*c*, an antenna 30*d* and a speaker portion 30*e*. The power supply portion 30*a* has a function of supplying power to each part of the headphone 30. The Bluetooth module 30*c* has a function of performing data information processing when performing data communication with the security device 10 through the antenna 30*d*. The Bluetooth module 30*c* is formed to be capable of being connected to an audio device (not shown) or the like having an embedded Bluetooth module. The control portion 30*b* is formed to be capable of acquiring audio signals being reproduced by the audio device (not shown) through the Bluetooth module 30*c*. In other words, this headphone 30 is so formed that the speaker portion 30*e* can make a sound being reproduced by the audio device (not shown) through Bluetooth communication also when an audio cable (not shown) is not connected to the audio device (not shown). The control portion 30*b* is formed to be capable of changing the magnitude of a sound emitted from the speaker portion 30*e* on the basis of an operation signal transmitted from the security device 10 through the Bluetooth module 30*c*.

The portable terminal 40 is a portable terminal to which the E-mail address stored in the storage portion 15 of the aforementioned security device 10 is assigned and is formed to be capable of performing Internet communication by employing the external communication base station 100. More specifically, the portable terminal 40 is constituted by a power supply portion 41, a control portion 42 controlling the portable terminal 40, a communication control portion 43, a network interface 44 corresponding to WAN (Wide Area Network), an antenna 45 and a display portion 46 formed by an LCD display. The power supply portion 41 has a function of supplying power to each part of the portable terminal 40. The communication control portion 43 has functions of performing receipt processing of an E-mail or the like sent from the security device 10 and performing transmission processing of an E-mail or the like transmitted from the portable terminal 40. The external network interface 44 has a window function of receiving an E-mail or the like sent from the communication base station 100 (see FIG. 1) through the antenna 45 and sending an E-mail or the like through the antenna 45. The display portion 46 has a function of displaying an operation screen when operating the portable terminal 40 and the received E-mail or the like.

The indoor sensor 50 and the outdoor sensor 60 are placed inside (not shown) and outside the user's house as shown in FIG. 1 and are motion sensors detecting whether or not a human such as an intruder exists inside and outside the user's house. The indoor sensor 50 and the outdoor sensor 60 are formed to inform the security device 10 whether or not a human such as an intruder exists inside and outside the user's house, respectively. More specifically, the indoor sensor 50 is constituted by a power supply portion 51, a control portion 52 controlling the indoor sensor 50, a specified low power radio module 53, an antenna 54 and a detection portion 55 detecting the existence of a human, as shown in FIG. 2. The outdoor sensor 60 is constituted by a power supply portion 61, a control portion 62, a specified low power radio module 63, an antenna 64 and a detection portion 65, similarly to the indoor sensor 50. The power supply portions 51 and 61 each have a function of supplying power to each part of the indoor sensor 50 and the outdoor sensor 60, respectively. The specified low power radio modules 53 and 63 are radio communication modules transmitting radio waves having a maximum electric power strength of not more than a prescribed magnitude (0.01 W), similarly to the aforementioned specified low power radio module 17 of the security device 10. In this case, the indoor sensor 50 and the outdoor sensor 60 transmit weak radio waves through the antennas 54 and 64 by the specified low power radio modules 53 and 63, respectively thereby being capable of communicating with the security device 10. The detection portions 55 and 65 are formed to detect an infrared ray or the like emitted from a human body. The control portions 52 and 62 are formed to transmit information about whether or not the detection portions 55 and 65 have detected the existence of a human inside and outside the user's house respectively by specified low power radio upon request of the security device 10.

The fire sensor 70 is placed inside (not shown) the user's house, as shown in FIG. 1 and has a function of detecting whether or not a fire is breaking out inside the user's house. The fire sensor 70 is formed to inform the security device 10 whether or not a fire is breaking out inside the user's house by specified low power radio. The fire sensor 70 is constituted by a power supply portion 71, a control portion 72, a specified low power radio module 73, an antenna 74 and a detection portion 75 similarly to the aforementioned indoor sensor 50 and outdoor sensor 60, as shown in FIG. 2.

The light 80 is placed inside the user's house, as shown in FIG. 1. This light 80 is constituted by a power supply portion 81, a control portion 82 controlling the light 80, a specified low power radio module 83, an antenna 84, a storage portion 85, and a red LED 86, a blue LED 87 and a green LED 88 serving as a light source of the light 80, as shown in FIG. 2. The power supply portion 81 has a function of supplying power to each part of the light 80. The specified low power radio module 83 is a radio communication module transmitting radio waves having a maximum electric power strength of not more than a prescribed magnitude (0.01 W). In this case, the light 80 transmits weak radio waves through the antenna 84 by the specified low power radio module 83 thereby being capable of communicating with the security device 10. The storage portion 85 previously stores illumination patterns of the red LED 86, the blue LED 87 and the green LED 88 described later, as shown in FIG. 3.

According to the embodiment, the control portion 82 is formed to blink any one of the red LED 86, the blue LED 87 and the green LED 88 on the basis of an operation signal from the control portion 14 when the control portion 14 of the security device 10 determines that the user cannot hear an alarm sound in a case where an abnormality occurs. More specifically, the control portion 82 is formed to control the red LED 86 in a first pattern in which repeating a short time T1 of lighting at a prescribed time interval causes blinking of a light when the fire sensor 70 detects a fire, as shown in FIG. 3. The control portion 82 is formed to control the blue LED 87 in a second pattern in which alternately repeating a short time T2 of lighting and a longer time T3 of lighting than time T2 causes blinking of a light when the indoor sensor 50 detects a human. The control portion 82 is formed to control the green LED 88 in a third pattern in which repeating a longer time T4 of lighting than times T1, T2 and T3 at a prescribed time interval causes blinking of a light when the outdoor sensor 60 detects a human. In other words, the control portion 82 is formed to vary a color and a blinking pattern depending on the type of an abnormality (abnormality detected by the fire sensor 70, the indoor sensor 50 or the outdoor sensor 60) and blink the light 80 in the user's house when the abnormality occurs.

Next, control flows the control portion 14 of the security device 10 and the control portion 82 of the light 80 in the security system 1 according to an embodiment of the present invention are described with reference to FIGS. 2 to 4.

Figure 4:
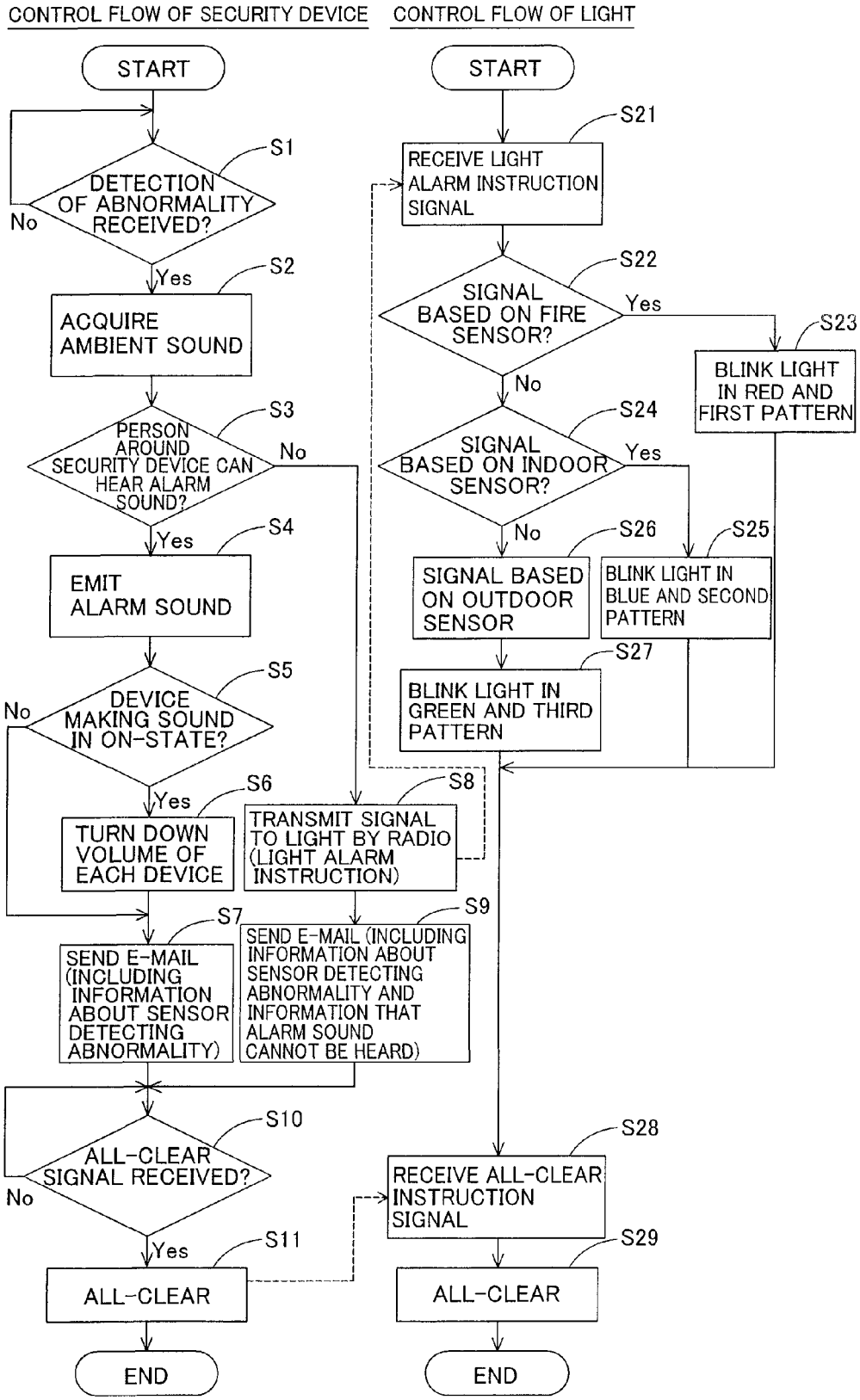
FIG. 4 is a flow chart for illustrating a control flow of a control portion of the security device and a control portion of a light in the security system according to the embodiment of the present invention.

As shown in FIG. 4, the control portion 14 (see FIG. 2) of the security device 10 determines whether or not detection of an abnormality has been received from any of the indoor sensor 50, the outdoor sensor 60 and the fire sensor 70 at a step S1. At the step S1, when the detection of the abnormality has not been received, this determination is repeated until the detection of the abnormality is received. At the step S1, when the detection of the abnormality has been received from any of the indoor sensor 50, the outdoor sensor 60 and the fire sensor 70, the control portion 14 advances to a step S2.

Then, the control portion 14 acquires sound (sound around the user) detected by the microphone 20 at the step S2 and determines whether or not those around the security device 10 can hear the alarm sound by comparing the magnitude of the sound around the user detected by the microphone 20 with the magnitude of the alarm sound capable of being generated from the speaker 19 at a step S3. At the step S3, when determining that the volume of the alarm sound is loud enough for those around the security device 10 to hear, the control portion 14 advances to a step S4.

At the step S4, the control portion 14 allows the speaker 19 to inform the abnormality with the alarm sound without blinking the light 80 and advances to a step S5. At the step S5, the control portion 14 determines whether or not devices making sounds such as the television device 21, the audio device 22 and the headphone 30 are in an ON-state. More specifically, at the step S5, confirmation signals for confirming whether or not the television device 21 and the audio device 22 are in the ON-state are transmitted to the television device 21 and the audio device 22 through the communication control portion 16 and the network interface 16*a*. When signals in response to the confirmation signals are returned, the control portion 14 determines that the television device 21 and the audio device 22 are in the ON-state, and when the signals in response to the confirmation signals are not returned, the control portion 14 determines that the television device 21 and the audio device 22 are in an OFF-state. Also, a confirmation signal for confirming whether or not the headphone 30 is in an ON-state is transmitted to the headphone 30 through the Bluetooth module 18 and the antenna 18*a*. When a signal in response to the confirmation signal is returned, the control portion 14 determines that the headphone 30 is in the ON-state, and when the signal in response to the confirmation signal is not returned, the control portion 14 determines that the headphone 30 is in an OFF-state.

At the step S5, when determining that the devices making sounds such as the television device 21, the audio device 22 and the headphone 30 are in the ON-state, the control portion 14 advances to a step S6. At the step S6, signals for turning down the volumes are transmitted to the television device 21, the audio device 22 and the headphone 30 being in the ON-state. In other words, the control portion 14 instructs the television device 21, the audio device 22 and the headphone 30 to turn down the volume. Thus, the control portion 21*b* of the television device 21, the control portion 22*b* of the audio device 22 and the control portion 30*b* of the headphone 30 control the speaker portion 21*e* of the television device 21, the speaker portion 22*e* of the audio device 22 and the speaker portion 30*e* of the headphone 30 to turn down the volumes. At the step S5, when determining that the devices making sounds such as the television device 21, the audio device 22 and the headphone 30 are not in the ON-state, the control portion 14 advances to a step S7.

Thereafter, an E-mail stating that there is an abnormality is sent to the E-mail address of the portable terminal 40 previously stored in the storage portion 15 at the step S7. In the E-mail of this portable terminal 40, the sensor (the indoor sensor 50, the outdoor sensor 60 and the fire sensor 70) detecting the abnormality is stated. In other words, the sensor detecting the abnormality is specifically stated in this E-mail, and hence the user can recognize what abnormality is occurring specifically.

At the step S3, when determining that the volume of the alarm sound is not loud enough for those around the security device 10 to hear, the control portion 14 advances to a step S8. At the step S8, when the indoor sensor 50 detects the abnormality, a signal corresponding to the abnormality detected by the indoor sensor 50 is communicated to the light 80 by radio through the specified low power radio module 17 and the antenna 18*a*. When the outdoor sensor 60 detects the abnormality, a signal corresponding to the abnormality detected by the outdoor sensor 60 is communicated to the light 80 by radio, and when the fire sensor 70 detects the abnormality, a signal corresponding to the abnormality detected by the fire sensor 70 is communicated to the light 80 by radio. Thus, a control flow of the light 80 described later is executed.

Thereafter, at a step S9, the E-mail stating that there is an abnormality is sent to the E-mail address of the portable terminal 40 stored in the storage portion 15. In the E-mail of this portable terminal 40, the sensor (the indoor sensor 50, the outdoor sensor 60 and the fire sensor 70) detecting the abnormality is stated. At the step S9, it is informed that it is a case where the user in the house cannot hear the alarm sound in addition to the aforementioned information about the abnormality, dissimilarly to the aforementioned step S7 in which the E-mail is sent in a state where the alarm sound can be heard.

Thereafter, at a step S10, the user or the like presses a stop button (not shown) of the alarm sound, whereby the control portion 14 determines whether or not an all-clear signal has been received. At the step S10, the aforementioned determination is repeated, and the control portion 14 advances to a step S11 when determining that the all-clear signal has been received.

At the step S11, an alarm is released, and the control flow of the control portion 14 of the security device 10 is terminated. At the step S11, an all-clear instruction signal is transmitted to the light 80 by radio through the specified low power radio module 17 and the antenna 18*a*.

The control flow of the control portion 82 of the light 80 is now described.

At a step S21, the control portion 82 of the light 80 acquires a light alarm instruction signal (abnormality signal from any of the indoor sensor 50, the outdoor sensor 60 and the fire sensor 70) transmitted from the control portion 14 of the security device 10 at the aforementioned step S8.

Thereafter, at a step S22, the control portion 82 determines whether or not the signal accepted at the aforementioned step S21 is a signal based on the abnormality detected by the fire sensor 70. When determining that the accepted signal is the signal based on the abnormality detected by the fire sensor 70 at the step S22, the control portion 82 advances to a step S23. At the step S23, the control portion 82 blinks the red LED 86 of the light 80 in the first pattern (see FIG. 3) corresponding to a case of the abnormality detected by the fire sensor 70 and advances to a step S28 described later. When determining that the accepted signal is not the signal based on the abnormality detected by the fire sensor 70 at the step S22, the control portion 82 advances to a step S24.

Thereafter, at the step S24, the control portion 82 determines whether or not the signal accepted at the aforementioned step S21 is a signal based on the abnormality detected by the indoor sensor 50. When determining that the accepted signal is the signal based on the abnormality detected by the indoor sensor 50 at the step S24, the control portion 82 advances to a step S25. At the step S25, the control portion 82 blinks the blue LED 87 of the light 80 in the second pattern (see FIG. 3) corresponding to a case of the abnormality detected by the indoor sensor 50 and advances to the step S28 described later. When determining that the accepted signal is not the signal based on the abnormality detected by the indoor sensor 50 at the step S24, the control portion 82 advances to a step S26.

At the step S26, the control portion 82 determines that the signal accepted at the aforementioned step S21 is a signal based on the abnormality detected by the outdoor sensor 60 and advances to a step S27. At the step S27, the control portion 82 blinks the green LED 88 of the light 80 in the third pattern (see FIG. 3) corresponding to a case of the abnormality detected by the outdoor sensor 60 and advances to the step S28.

Thereafter, at the step S28, the control portion 82 accepts the all-clear instruction signal transmitted from the control portion 14 of the security device 10 at the aforementioned step S11. In other words, the control portion recognizes that the user or the like has pressed the stop button (not shown) of the alarm sound. At a step S29, the alarm is released, and the control flow of the control portion 82 of the light 80 is terminated.

According to this embodiment, as hereinabove described, when an abnormality occurs, the control portion 14 determines whether or not the user can hear the alarm sound for informing the user of the abnormality, and generates the alarm sound or blinks the light 80 in the user's house depending on the determination whether or not the user can hear the alarm sound thereby informing the user of the abnormality, so that the user can be informed of the abnormality by selecting either the alarm sound or the blinking of the light 80 on the basis of the determination whether the user can hear or cannot hear the alarm sound. Thus, the user can be informed of the abnormality without both generating the alarm sound and blinking the light 80, and hence increase in power consumption of the security device 10 at the time of informing the user of the abnormality can be suppressed as compared with a case where the user is always informed of the abnormality by both the alarm sound and the blinking of the light 80.

According to this embodiment, as hereinabove described, the control portion informs the user of an abnormality by blinking the light 80 in the user's house without generating the alarm sound when determining that the user cannot hear the alarm sound, and the control portion informs the user of the abnormality by generating the alarm sound without blinking the light 80 in the user's house when determining that the user can hear the alarm sound, so that the control portion can inform the user of the abnormality by blinking the light 80 in the user's house without generating the alarm sound under an environment where the user cannot hear the alarm sound, and the control portion can inform the user of the abnormality by generating the alarm sound without blinking the light 80 in the user's house under an environment where the user can hear the alarm sound. Thus, the user can be informed of the abnormality by employing only either a sound or a light, and hence increase in power consumption of the security device at the time of informing the user of the abnormality can be further suppressed.

According to this embodiment, as hereinabove described, the control portion determines whether or not the user can hear the alarm sound on the basis of the magnitude of the sound around the user at the time of informing the user of an abnormality and the magnitude of the alarm sound, whereby the control portion can easily determine whether or not the user can hear the alarm sound by comparing the magnitude of the sound around the user at the time of informing the user of the abnormality with the magnitude of the alarm sound.

According to this embodiment, as hereinabove described, the control portion varies an illumination color and an emission pattern depending on the type of an abnormality and controls the light 80 in the user's house to blink when the abnormality occurs, whereby the user can easily recognize the type of the abnormality on the basis of the color or the blinking pattern of the light 80 corresponding to the type of the abnormality (abnormality detected by the indoor sensor 50, the outdoor sensor 60 or the fire sensor 70) when being informed of the abnormality by the light 80.

According to this embodiment, as hereinabove described, the user is informed of an abnormality by the alarm sound from the speaker 19 or the light 80 and the previously registered portable terminal 40 is informed of the information about the abnormality by the communication control portion 16 and the network interface **16*a* when the abnormality occurs, whereby a third party going out etc. other than the user in the house can be informed of the abnormality if the third party other than the user in the house has the previously registered portable terminal 40**, and hence it can be more reliably informed of the abnormality.

According to this embodiment, as hereinabove described, the control portion turns down the volumes of sounds emitted from the devices (the television device 21, the audio device 22 and the headphone 30) being in an ON-state when determining that the devices (the television device 21, the audio device 22 and the headphone 30) making sounds, capable of communicating with the communication portions (the communication control portion 16 and the Bluetooth module 18) are in an ON-state in a case of determining that the user can hear the alarm sound, whereby the alarm sound can be more easily received by the user by turning down the volumes of the sounds emitted from the devices making sounds when the user is informed of an abnormality by the alarm sound.

Although the present invention has been described and illustrated in detail, it is clearly understood that the same is by way of illustration and example only and is not to be taken by way of limitation, the spirit and scope of the present invention being limited only by the terms of the appended claims.

For example, while the security device having the electronic photo frame with a security function is applied to the present invention in the aforementioned embodiment, the present invention is not restricted to this. A security device having a device with a security function other than the electronic photo frame, such as a security device having a television device, a router or the like with a security function may be applied to the present invention, for example. A security device having only a security function may be applied to the present invention without integrating a security function into another device.

While the control portion blinks the light without generating the alarm sound when determining that the user cannot hear the alarm sound in the aforementioned embodiment, the present invention is not restricted to this. When determining that the user cannot hear the alarm sound, the control portion may generate the alarm sound and blink or illuminate the light, for example. When the alarm sound can be heard, the user is informed of an abnormality only by the alarm sound and the light is not illuminated or blinked, and hence increase in power consumption can be further suppressed as compared with a case where the user is informed of the abnormality by the alarm sound and the light in all cases.

While the control portion blinks the light when determining that the user cannot hear the alarm sound in the aforementioned embodiment, the present invention is not restricted to this. The light may be allowed to be illuminated, for example.

While the control portion blinks the red LED in the first pattern when informing the user of an abnormality detected by the fire sensor, the blue LED in the second pattern when informing the user of an abnormality detected by the indoor sensor and the green LED in the third pattern when informing the user of an abnormality detected by the outdoor sensor in the aforementioned embodiment, the present invention is not restricted to this. The light may be blinked in one color of red, blue, green or white and in the aforementioned first to third patterns corresponding to the respective abnormalities without setting the type of colors of red, blue and green, or the light may be illuminated or blinked by varying only colors with the red, blue or green LED corresponding to each of the abnormalities without setting the aforementioned first to third patterns, for example. Alternatively, the user may be informed of an abnormality by illuminating or blinking the light without setting color patterns and blinking patterns.

While the control portion is formed to turn down the volume of the headphone capable of Bluetooth communication through the Bluetooth module when determining that the user can hear the alarm sound in the aforementioned embodiment, the present invention is not restricted to this. In case of a headphone incapable of Bluetooth communication, the control portion may be formed to turn down the volume of the audio device through LAN communication or may be formed to turn down the volume of the headphone by another communication method such as infrared communication, for example.

While three alarm patterns corresponding to any of the fire sensor, the indoor sensor and the outdoor sensor have been shown in the aforementioned embodiment, the present invention is not restricted to this. When a sensor except the aforementioned sensors is provided, a new alarm pattern corresponding to the sensor except the aforementioned sensors may be provided, for example.

While the security device is provided with the speaker emitting the alarm sound in the aforementioned embodiment, the present invention is not restricted to this. A speaker of another device such as the speaker portion of the audio device may emit an alarm sound or a new speaker device separately provided may emit an alarm sound, for example.

While the control portion is formed to turn down the volumes of the devices making sounds such as the headphone, the television device and the audio device when determining that the user can hear the alarm sound in the aforementioned embodiment, the present invention is not restricted to this. The control portion may be formed to eliminate the sounds of the devices making sounds such as the headphone, the television device and the audio device or may be formed to turn off the devices making sounds, for example.

What is claimed is:

1. A security device comprising:

a security device body placed in a house of a user; and a control portion provided inside said security device body, determining whether or not the user can hear an alarm sound for informing the user of an abnormality when said abnormality occurs and informing the user of said abnormality by generating said alarm sound, or illuminating or blinking a light in the house of the user, depending on determination whether or not the user can hear said alarm sound.

2. The security device according to claim 1, wherein said control portion is formed to inform the user of said abnormality by illuminating or blinking said light in the house of the user without generating said alarm sound when determining that the user cannot hear said alarm sound and inform the user of said abnormality by generating said alarm sound without illuminating or blinking said light in the house of the user when determining that the user can hear said alarm sound.

3. The security device according to claim 1, wherein said control portion is formed to determine whether or not the user can hear said alarm sound on the basis of the magnitude of sound around the user at the time of informing the user of said abnormality and the magnitude of said alarm sound.

4. The security device according to claim 1, wherein said control portion is formed to vary at least either an illumination color or an emission pattern depending on the type of said abnormality and illuminate or blink said light in the house of the user when said abnormality occurs.

5. The security device according to claim 1, further comprising a communication portion provided in said security device body, wherein said control portion is formed to inform the user of said abnormality by said alarm sound or said light and inform a previously registered portable terminal of information about said abnormality through said communication portion when said abnormality occurs.

6. The security device according to claim 5, wherein said control portion is formed to inform said previously registered portable terminal that it is a case where the user cannot hear said alarm sound in addition to the information about said abnormality when informing said previously registered portable terminal of the information about said abnormality in a case of determining that the user cannot hear said alarm sound.

7. The security device according to claim 5, wherein said control portion is formed to inform said previously registered portable terminal of the information about said abnormality through said communication portion by employing an E-mail when said abnormality occurs.

8. The security device according to claim 1, further comprising a communication portion provided in said security device body, wherein said control portion is formed to turn down the volume of a sound emitted from a device making a sound, capable of communicating with said communication portion, being in an ON-state when determining that said device is in said ON-state in a case of determining that the user can hear said alarm sound.

9. The security device according to claim 8, wherein said device making a sound includes a headphone capable of communication through radio communication, said communication portion is formed to communicate with said headphone through radio communication, and said control portion is formed to turn down the volume of a sound emitted from said headphone being in an ON-state through said communication portion communicating with said headphone through radio communication when determining that said headphone is in said ON-state.

10. The security device according to claim 1, further comprising an informing portion capable of generating an alarm sound, wherein said control portion is formed to allow said informing portion to emit said alarm sound when determining that the user can hear said alarm sound.

11. The security device according to claim 1, further comprising a sound detection portion detecting sound around the user, wherein said control portion is formed to determine whether or not the user can hear said alarm sound on the basis of the magnitude of sound around the user at the time when said abnormality occurs, detected by said sound detection portion and the magnitude of said alarm sound.

12. The security device according to claim 1, further comprising a display portion serving as an electronic photo frame, capable of displaying a photo image.

13. The security device according to claim 1, further comprising a communication portion provided in said security device body, wherein said abnormality is detected by a motion sensor detecting an intruder, and said control portion is formed to determine that said abnormality is occurring when being informed of information about said abnormality detected by said motion sensor through said communication portion.

14. The security device according to claim 13, wherein said communication portion includes a specified low power radio module capable of communicating with said motion sensor by a radio communication module having a maximum electric power strength of not more than a prescribed magnitude, and said control portion is formed to determine that said abnormality is occurring when being informed of the information about said abnormality detected by said motion sensor through said specified low power radio module.

15. The security device according to claim 1, further comprising a communication portion provided in said security device body, wherein said abnormality is detected by a fire sensor detecting whether or not a fire is breaking out, and said control portion is formed to determine that said abnormality is occurring when being informed of information about said abnormality detected by said fire sensor through said communication portion.

16. A security system comprising:

a light placed in a house of a user; and a security device including a security device body placed in the house of the user and a control portion provided inside said security device body, determining whether or not the user can hear an alarm sound for informing the user of an abnormality when said abnormality occurs and informing the user of said abnormality by generating said alarm sound, or illuminating or blinking said light in the house of the user, depending on determination whether or not the user can hear said alarm sound.

17. The security system according to claim 16, wherein said control portion of said security device is formed to inform the user of said abnormality by illuminating or blinking said light in the house of the user without generating said alarm sound when determining that the user cannot hear said alarm sound and inform the user of said abnormality by generating said alarm sound without illuminating or blinking said light in the house of the user when determining that the user can hear said alarm sound.

18. The security system according to claim 16, wherein said control portion of said security device is formed to determine whether or not the user can hear said alarm sound on the basis of the magnitude of sound around the user at the time of informing the user of said abnormality and the magnitude of said alarm sound.

19. The security system according to claim 16, wherein said control portion of said security device is formed to vary at least either an illumination color or an emission pattern depending on the type of said abnormality and illuminate or blink said light in the house of the user when said abnormality occurs.

20. The security system according to claim 16, wherein said security device further includes a communication portion provided in said security device body, and said control portion of said security device is formed to inform the user of said abnormality by said alarm sound or said light and inform a previously registered portable terminal of information about said abnormality through said communication portion when said abnormality occurs.

* * * * *